United States Patent [19]

Takizaki

[11] Patent Number: 4,814,570

[45] Date of Patent: Mar. 21, 1989

[54] AUTOMATIC HEATING APPARATUS PROVIDED WITH GAS AND WEIGHT SENSORS

[75] Inventor: Takeshi Takizaki, Yamatokoriyama, Japan

[73] Assignee: Matsushita Electric Industrial Co., Ltd., Kadoma, Japan

[21] Appl. No.: 219,791

[22] Filed: Jul. 14, 1988

Related U.S. Application Data

[63] Continuation of Ser. No. 25,276, Mar. 12, 1987, abandoned.

[30] Foreign Application Priority Data

Mar. 20, 1986 [JP] Japan ..... 61-62279

[51] Int. Cl.[4] ..... H05B 6/68

[52] U.S. Cl. ..... 219/10.55 B; 219/10.55 M; 219/518; 99/325; 99/DIG. 14

[58] Field of Search ..... 219/10.55 B, 10.55 E, 219/10.55 R, 10.55 M, 492, 497, 518; 99/325, 328, 330, DIG. 14

[56] References Cited

U.S. PATENT DOCUMENTS

| | | | |
|---|---|---|---|
| 4,097,707 | 6/1978 | Kobayashi et al. | 219/10.55 B |
| 4,350,860 | 9/1982 | Ueda | 219/10.55 B |
| 4,447,693 | 5/1984 | Buck | 219/10.55 B X |
| 4,590,350 | 5/1986 | Ueda | 219/10.55 B |
| 4,591,684 | 5/1986 | Tanabe et al. | 219/10.55 B |

FOREIGN PATENT DOCUMENTS

| | | |
|---|---|---|
| 0025513 | 3/1981 | European Pat. Off. . |
| 0027711 | 4/1981 | European Pat. Off. . |
| 0031589 | 11/1981 | European Pat. Off. . |
| 0146406 | 6/1985 | European Pat. Off. . |
| 0166997 | 1/1986 | European Pat. Off. . |
| 3205124 | 8/1983 | Fed. Rep. of Germany . |

*Primary Examiner*—Philip H. Leung

*Attorney, Agent, or Firm*—Wenderoth, Lind & Ponack

[57] ABSTRACT

In an automatic cooking of cake, a gas sensor and a weight sensor are used to determine a total heating time. The initial weight of a food item (cake) is measured by the weight sensor, and a time ($T_W$) proportional to a detected value of the weight sensor is determined. The amount ($\Delta H$) of change in humidity level until an arbitrarily chosen timing is detected by the gas sensor, and a time ($T_{(\Delta H)}$) proportional to a detected value of the gas sensor is determined. These times ($T_W$) and ($T_{(\Delta H)}$) are added together to determine a total cooking time. With this arrangement, regardless of the kind and amount of cake and the shape of a vessel, the automatic cooking capable of giving a fine finish can be accomplished merely by selecting a single auto-key called a cake key.

11 Claims, 4 Drawing Sheets

AUTOMATIC HEATING APPARATUS PROVIDED WITH GAS AND WEIGHT SENSORS

This application is a continuation, of now abandoned application Ser. No. 025,276, filed Mar. 12, 1987.

BACKGROUND OF THE INVENTION

The present invention relates to a heating apparatus provided with a weight sensor for measuring the weight of one or more food items which are a material to be heated and a gas sensor for detecting the amount of change of a physical parameter such as, for example, gas or vapor generated from the food material being cooked and, more particularly, to an automatic cooking apparatus for cakes to be baked in an oven.

A heating apparatus capable of controlling the length of heating time automatically is currently widely utilized. For example, an automatic electronic range having an oven function is rated highly of its convenience and heavily occupies the market of heating and cooking apparatuses. However, the conventional oven cooking, for example, automatic cooking of cakes, cookies, cream puffs and others, is carried out by detecting the temperature in a heating chamber with the use of a temperature sensor such as a thermistor, then measuring the time elapsed from the start of heating until the temperature inside the heating chamber attains a controlled temperature, and multiplying the elapsed time by a certain constant to determine the total heating time.

More specifically, the conventional oven cooking employs a control sequence wherein the temperature inside the heating chamber, in which the food material is placed, by the use of a temperature sensor such as a thermistor, the time $T_1$ required for the temperature inside the heating chamber to attain a controlled temperature subsequent to the start of heating is then measured by the use of a timer, the time $T_1$ is multiplied by an artitrarily chosen constant k, and finally a predetermined heating time A is added to the product of the time $T_1$ times the arbitrary constant k, i.e., $A+k \cdot T_1$, thereby to give the total heating time during which the food material is heated.

Although the conventional heating apparatus utilizing this control sequence can accommodate, to a certain extent, change in environment (temperature and so on) and/or power source voltage, it has the following problems.

(1) Since a particular base heating time A and a particular constant k are allocated to each automatic cooking key, one automatic cooking key cannot be used for cooking different items of a menu. By way of example, when it comes to a cake, there is a variety of cakes, such as, for example, sponge cake, bundt cake, batter cake and so on, each requiring a different heating time. Therefore, types of cakes acceptable to the conventional automatic cooking are limited.

(2) When the amount of material to be cooked changes, it cannot be properly cooked. Since both the base heating time A and the constant k are fixed, the conventional heating apparatus works satisfactorily with specified amounts illustrated in a cookbook available as an accessory to the heating apparatus. For example, if the amount is decreased to half the specified amount, excessive baking occurs, but if it is increased to twice the specified amount, insufficient baking occurs.

(3) A vessel usable in the conventional heating apparatus is limited in shape. Particularly, in the case of cake making, the required heating time varies with the shape of a vessel. For example, the use of a shallow vessel with large opening area requires a smaller heating time than the use of a deep vessel with small opening area. The conventional heating apparatus cannot accommodate changing shapes of vessels, and the shape of the vessel usable therein is limited.

As hereinabove discussed, the conventional automatic heating apparatus for oven cooking has limited applications as to the type, the amount and the shape of a vessel useable. In order to obviate these limitations, the present invention makes use of a weight sensor and a gas sensor.

Although a means for carrying out an automatic cooking by the combined use of the weight and gas sensors is utilized in a warming mode of the automatic cooking utilizing a mirowave heating technique, the manner in which it is used will be described hereinafter. Simultaneously with the start of cooking, the weight of the food material is measured by the weight sensor, and a time limit of the cooking appropriate to the measured weight is set. The greater the weight, the longer the heating time and, therefore, the time limit is so set as to be long. At the same time, measurement of vapor produced by the food material is also performed by the gas sensor, and, at the time the level of vapor so measured has attained a predetermined detection level, the total cooking time is fixed on the basis of the time elapsed from the start of cooking and until the level of vapor so measured attains the predetermined detection level. Then, the cooking time determined upon the detection by the vapor sensor and the time limit determined by the weight sensor and appropriate to the particular weight are compared, and the cooking terminates upon the passage of one of the times which is smaller than the other. Although in the case of warming of most food materials, the cooking time is determined by the gas sensor, excessive heating would occur often in the case of the food material having a small weight if controlled by the gas sensor and, therefore, arrangement is made to terminate the cooking early by relying on the weight. The utilization of the gas and weight sensors in the microwave heating discussed above is such that one of them is used as an auxiliary limiter to the other of them, and both are simultaneously utilized only when the food material is extremely small or under such circumstances.

In the heating apparatus according to the present invention, both the gas sensor and the weight sensor are effectively utilized, and it is so constructed that a base heating time $T_{(W)}$ appropriate to the weight of a food material and an added heating time $T_{(\Delta H)}$ are determined by the weight sensor and the gas sensor, respectively, the sum of the base heating time and the added heating time, that is, $T_{(W)}+T_{(\Delta H)}$, representing the total cooking time $T_{total}$ during which the actual cooking is performed. With this construction, it has now become possible that change in heating time with the weight of the food material can be adjusted by the base heating time $T_{(W)}$, whereas change in heating time with the type of the food material and/or the shape of the vessel can be adjusted by the added heating time $T_{(\Delta H)}$.

Moreover, in the present invention, change in heating time which has resulted from the type of cake is adjusted by the gas sensor. Conventionally, there is an example wherein in a warming mode of the automatic cooking by the use of the microwave heating technique, the gas sensor is used to determine the type of a food material and then to adjust the heating time. According to this method, the rate of change of a detection output from the gas sensor generated during the heating operation is measured so that the type of a food material can be discriminated in the light of the measured value and the cooking time is subsequently adjusted by varying the value of detection level. However, this method cannot be utilized in the oven cooking of cakes or the like, because, while the oven cooking is carried out only by increasing the temperature inside the heating chamber, change of the temperature being increased takes place slowly with the rate thereof being small, requiring a relatively long time to heat the food material to a required temperature. Also, in order to adjust the temperature inside the heating chamber, a heating means such as a heater is repeatedly switched on and off. As a matter of course, much vapor is produced when the heater is switched on, but little vapor is produced when it is switched off. Influenced by the on and off switching of the heater, the rate of change of the vapor detected by the gas sensor fluctuates. Because of this, when the type of food material is to be discriminated depending on the rate of change of the vapor generation, no difference can be ascertained in type because the rate of change as a whole is small, and accurate discrimination cannot be achieved because of fluctuation of the rate of change. The present invention has been devised with regards paid to these problems and makes use of the amount of change, not the rate of change, in adjusting the cooking time peculiar to a particular cake.

As hereinbefore discussed, the establishment of a new technology necessary to automate the oven cooking of cakes or the like has been longed for.

SUMMARY OF THE INVENTION

In view of the foregoing, the present invention has for its essential object to provide an improved heating apparatus of a type having an excellent cooking capability, wherein a plurality of types of cakes can be cooked one at a time merely by selecting an automatic cooking key for cake cooking and without being affected by change in amount and/or type of vessel used.

In order to accomplish this object of the present invention, the heating apparatus herein disclosed comprises a heating chamber for accommodating a material to be heated, a heating unit for heating and cooking the material, a gas sensor for detecting the amount of physical change such as of humidity within the heating chamber, a weight sensor for detecting the weight of the material, a timer means for counting the time passed subsequent to the start of heating, an arithmetic means capable of performing a calculation by the use of respective detected values from the gas and weight sensors, and an output control means for controlling an output of the heating unit according to a signal from the arithmetic means.

The arithmetic means makes use of the timer means to measure the heating time which has been passed; calculates the difference between the minimum detected value of the gas sensor prior to the passage of a predetermined time subsequent to the start of heating and the detected value subsequent to the passage of the predetermined time; performs a calculation with the use of the calculated value as a variable to determine an added heating time $T_{(\Delta H)}$; performs a calculation with the use of the detected value of the weight sensor as a variable to determine a base heating time $T_{(W)}$; adding the times $T_{(\Delta H)}$ and $T_{(W)}$ together to provide the total heating time $T_{total}$ $(=T_{(W)}+T_{(\Delta H)})$; and applies a signal to the output control means to control the output of the heating unit. Thus, since the detected values representative of the weight of the material to be heated and the gas produced from the material, respectively, are both utilized to calculate the total heating time, the cooking can be carried out in an optimum cooking time without being affected by the kind and amount of the material and the shape of the vessel used.

Moreover, since the amount of change between the detected value of the gas sensor after the predetermined time subsequent to the start of cooking and the minimum value up until this time is used as a variable necessary to calculate the heating time, change in output from the gas sensor is slow and, even if affected by the heater being switched on and off, the control means can perform its control operation with minimized error.

In addition, the detection by the sensor necessarily takes place after the predetermined time subsequent to the start of heating so that the calculation can be carried out to enable the remaining time to be displayed. Therefore, the apparatus according to the present invention is easy to handle and convenient to the user since the remaining time can be displayed at definite times.

BRIEF DESCRIPTION OF THE DRAWINGS

This and other objects and features of the present invention will become apparent from the following description taken in conjunction with a preferred embodiment thereof with reference to the accompanying drawings, in which.

DETAILED DESCRIPTION OF THE EMBODIMENT

Figure 1:
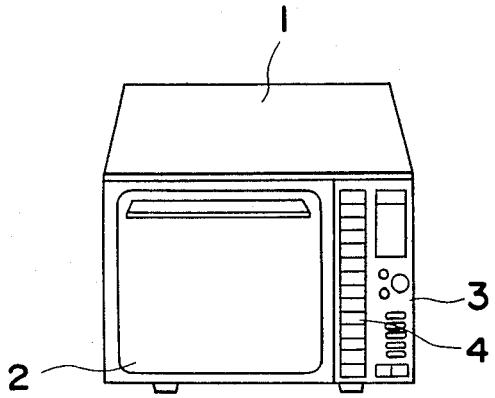
FIG. 1 is a perspective view of a heating apparatus embodying the present invention.

Referring first to FIG. 1, a heating apparatus shown therein comprises an enclosure 1 having a front access opening defined therein, a hingedly supported door 2 for selectively opening and closing the access opening in the enclosure 1, and an operating panel 3 positioned laterally of the access opening and next to the door 2. The operating panel 3 is provided with a plurality of auto-keys 4 and, by manipulating any one of the auto-keys 4, the user of the apparatus can enjoy automatic cooking of a desired menu.

Figure 2:
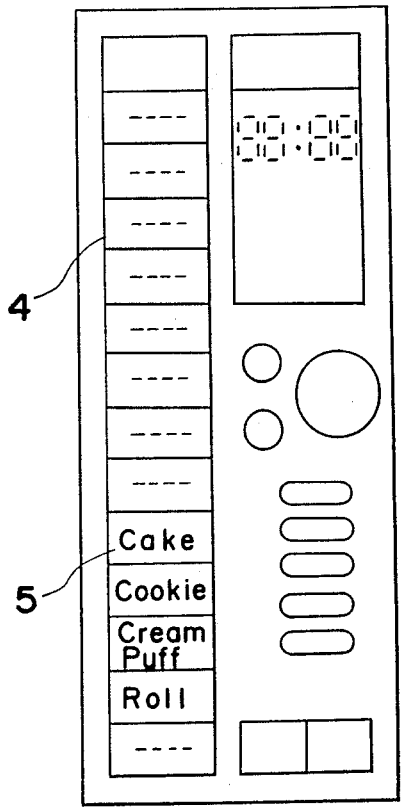
FIG. 2 is a front elevational view, on an enlarged scale, of an operating panel used in the apparatus of FIG. 1.

The details of the operating panel 3 are best shown in FIG. 2. The auto-keys 4 are provided for a corresponding number of menus and include a cake key 5. According to the prior art as hereinbefore discussed, the kind of cake that can be made with the cake key 5 is limited to, for example, a sponge cake, or different keys are used for, for example, a sponge cake and a pound cake, respectively. However, thanks to the present invention, one and the same key can be used for making different kinds of cake, for example, not only a sponge cake, but also a pound cake and a cheesecake, and therefore, the key 5 is simply called the "cake key".

Figure 3:
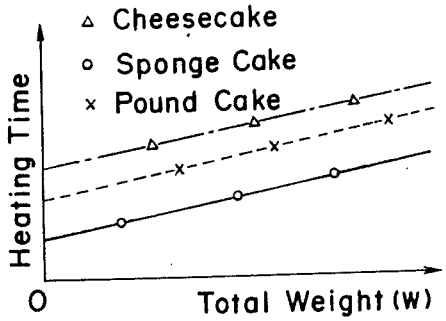
FIG. 3 is a chart showing the relationship between the weight of some cakes and the heating time required for each cake.

FIG. 3 illustrates the graph wherein the axis of abscissas represents the total weight of a material to be heated including the weight of a vessel, and the axis of ordinates represents the required heating time. In this graph, the heating time required to make each of the sponge cake, the pound cake and the cheesecake is shown together with the weight thereof. The graph shows that, given the weight of each cake, the length of heating time required to make each of these cakes is long in the order of cheesecake, pound cake and sponge cake.

Figure 4:
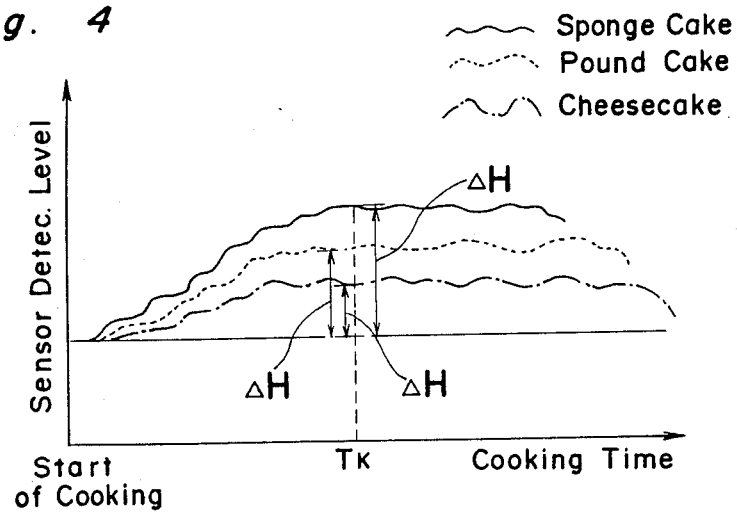
FIG. 4 is a graph showing the change with time of the detected level of a gas sensor during the cooking of a cake.

FIG. 4 illustrates the graph wherein the axis of abscissas represents the cooking time and the axis of ordinates represents the detected level of a gas sensor. This graph illustrates the detected level of the gas sensor which occurs subsequent to the start of cooking of each cake and until the termination of the cooking. Generation of vapor from each cake increases with increase of the temperature inside a heating chamber in the enclosure. It is to be noted that each curve shown in FIG. 4 exhibits a wavy fluctuation as a result of a heater having been alternately switched on and off, that is, because vapor is easy to occur when the heater is switched on and decreases when it is switched off. Generation of vapor reaches a state of equilibrium when the temperature inside the heating chamber becomes constant and the temperature of the cake being cooked increases sufficiently. For a moment subsequent thereto, increase and decrease alternate adjacent a constant level, and the level decreases at about the termination of the cooking. Considering the generation of vapor from each of the cakes, the maximum value of the detected level increases in the order of sponge cake, pound cake and cheesecake. In other words, it can be said that the amount $\Delta H$ of change in vapor which occurs subsequent to the start of cooking and until a certain timing $T_k$ increases in the order of sponge cake, pound cake and cheesecake.

Figure 5:
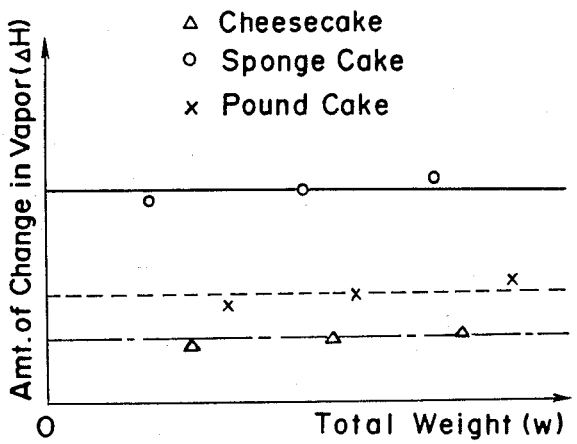
FIG. 5 is a graph showing the relationship between the amount of the cake and the amount of change in vapor of the cake.

FIG. 5 is a graph wherein the axis of abscissas represents the total weight of the material to be heated and the axis of ordinates represents the amount $\Delta H$ of change in vapor which occurs subsequent to the start of cooking and until a certain timing $T_k$. The amount of change in vapor increases in the order of sponge cake, pound cake and cheesecake and may be said to be substantially constant although there is a variation to some extent, depending on the weight.

Figure 6:
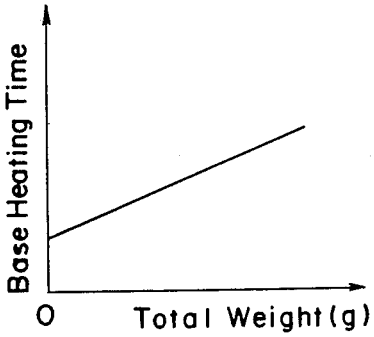
FIG. 6 is a graph showing the relationship between the weight W of the cake and the base heating time $T_{(W)}$ in one embodiment of the present invention.
Figure 7:
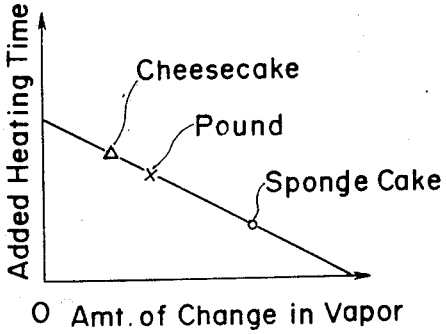
FIG. 7 is a graph showing the relationship between the amount ΔH of change in vapor of the cake and the added heating time $T_{(\Delta H)}$.
Figure 8:
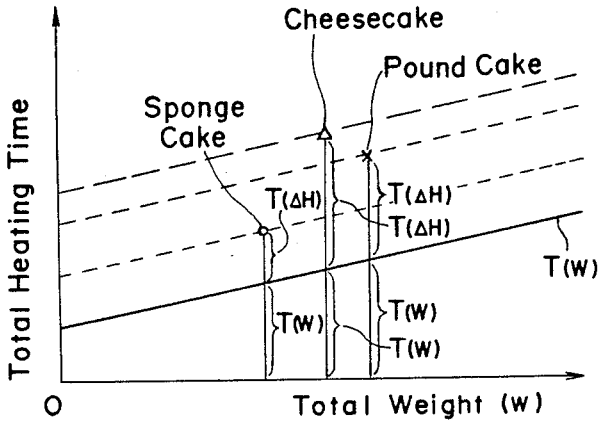
FIG. 8 is a graph showing the relationship between the weight W and the total heating time $T_{total}$.

The present invention is based on the finding of the above discussed relationships. As show in FIG. 6, the base heating time $T_{(W)}$ appropriate to the total weight of the material to be heated is fixed as a positive linear function wherein the total weight W is taken as a variable. Also, as shown in FIG. 7, the added heating time $T_{(\Delta H)}$ is fixed as a negative linear function wherein the amount $\Delta H$ of change in vapor subsequent to the start of cooking and until the predetermined timing $T_k$ (for example, 15 minutes in the illustrated example) is taken as a variable. Then, as shown in FIG. 8, the total heating time $T_{total}$ which is a cooking time is fixed as the sum of the base heating time $T_{(W)}$ and the added heating time $T_{total}(=T_{(W)}+T_{(\Delta H)})$. With this control sequence, even if the amount of cake which is the material to be heated varies to ½ or 2 times, an optimum heating time can be calculated with the base heating time $T_{(W)}$, and even if the kind of cake varies from one of the sponge cake, pound cake and cheesecake to another, the optimum heating time can be calculated with the added heating time $T_{(\Delta H)}$. Moreover, in view of the fact that the amount of vapor generated is great and the necessary heating time is small where a shallow vessel with relatively large area of opening is used, but, conversely, the amount of vapor generated is small and the necessary heating time is long where a deep vessel with relatively small area of opening is used, a substantially completely proper heating time can be calculated with the added heating time $T_{(\Delta H)}$.

A means for determining the necessary heating time in dependence on the amount of change in vapor generated from the cake until the predetermined timing $T_k$ can be theoretically understood if one is aware of the fact that, for a given weight, a great amount of change in vapor is indicative of the situation in which a food item has been thoroughly heated accompanied by the internal drying thereof and, therefore, the necessary cooking time suffices to be short, but conversely a small amount of change in vapor is indicatve of the situation in which a water component remains inside the food item and, therefore, the necessary cooking time has to be increased.

Figure 9:
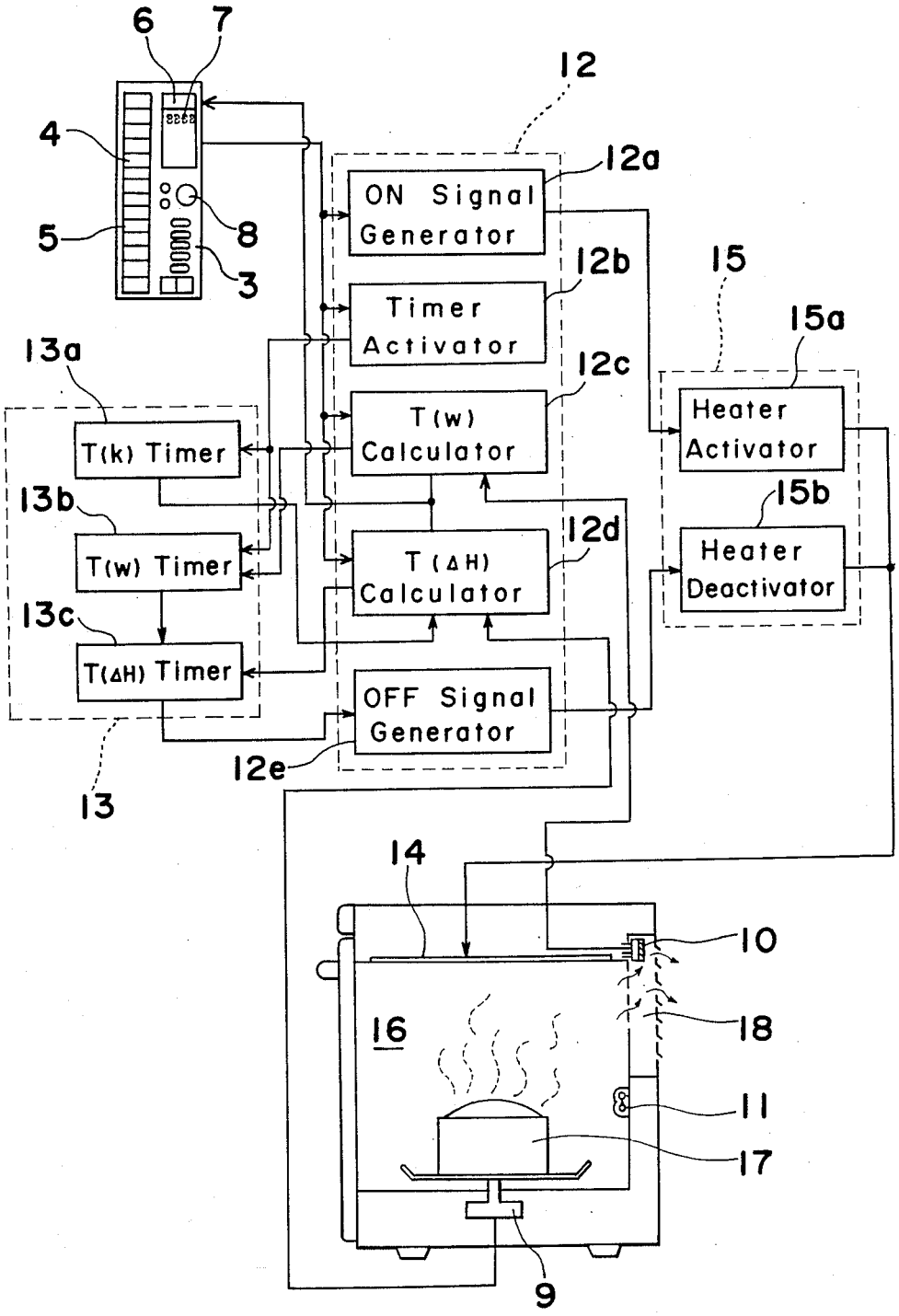
FIG. 9 is a circuit block diagram of the heating apparatus.

The details of the heating apparatus embodying the present invention will now be described with reference to FIG. 9. The operating panel 3 is provided with the plurality of the automatic cooking keys 4 including, inter alia, the cake key 5. The operating panel 3 is also provided with a start key 6, a display tube 7 for displaying the remaining time, and a timer knob 8. A printed electronic circuit board disposed rearwardly of the operating panel 3 is provided with a calculating means 12 for calculating information obtained from a weight sensor 9, a gas sensor 10 and a temperature sensor 11, a timer means 13 for counting a time, and an output control means 15 for controlling a heating unit 14. The calculating means 12 comprises ON and OFF signal generators **12*a* and 12*e* for generating respective signals for controlling the output control means 15, a timer activator 12*b* for activating the timer means 13, a $T_{(W)}$ calculator 12*c* for calculating a time appropriate to a weight, an a $T_{(\Delta H)}$ calculator 12*d* for calculating a time appropriate to the detected value of the gas sensor 10**.

The timer means 13 comprises a $T_{(k)}$ timer **13*a* for measuring a detection time, a $T_{(W)\ timer\ 13}b$ for measuring the time calculated by the $T_{(W)\ calculator\ 12}c$, and a $T_{(\Delta H)}$ timer 13*c* for measuring the time calculated by the $T_{(\Delta H)}$ calculator 12*b*. The output control means 15 comprises a heater activator and deactivator 15*a* and 15*b*** for initiating and interrupting the supply of an electric power to the heater which constitutes the heating unit.

Positioned above the heating chamber 16 is the heating unit 14, positioned below the heating chamber 16 is the weight sensor, and positioned inside the heating chamber 14 in opposition to the door is the temperature sensor 11. The gas sensor 10 is so disposed and so positioned in an exhaust guide 18 as to readily detect vapor being generated from the food material (cake) 17.

Figure 10:
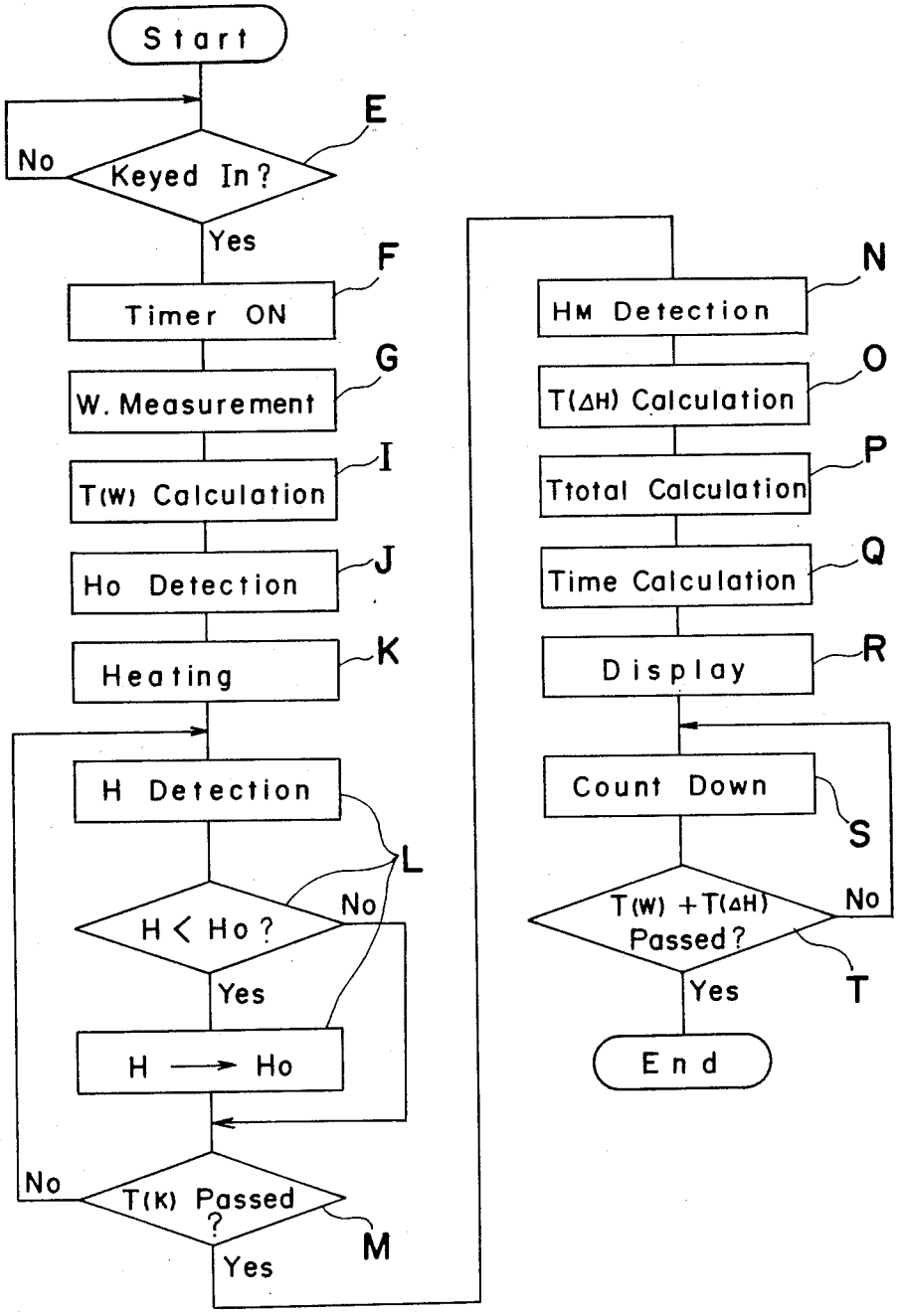
FIG. 10 is a flowchart showing the sequence of operation of the heating apparatus.

The operation will now be described with reference to the flowchart shown in FIG. 10. Assuming that the cake key 5 on the operating panel is selected, and the start key 6 is depressed at step E, the timer activator **12*b* issues a signal to the timer means 13 to bring the $T_{(k)}$ and $T_{(W)}$ timers 13*a* and 13*b* into operation to measure the respective times at step F. Then, the $T_{(W)}$ calculator 12*c* measures the weight of the food item (cake) 17 by means of the weight sensor 9 at step G, thereby to perform a calculation of $T_{(W)}$, the value of which is subsequently stored in the $T_{(W)}$ timer 13*b* at step I. At step J, the $T_{(\Delta H)}$ calculator 12*d* detects the initial humidity level by means of the gas sensor 10. After the initial setting as hereinabove described, the ON signal generator 12*a* supplies a signal to the heater activator 15*a* to enable the supply of an electric power to the heating unit 14 at step K. Thereafter, the $T_{(\Delta H)}$ calculator 12*d* monitors the humidity level until the detection timing $T_{(k)}$ and repeats such an operation (at step L) that, should it detect the humidity lever lower than Ho, the humidity level can be updated to Ho. This applies where a continues cooking is carried out and is an operation to render the minimum value of the humidity level to be Ho. The $T_{(k)}$ timer 13*a*, when the predetermined detection timing $T_{(k)}$ comes, supplies a signal to the $T_{(\Delta H)}$ calculator 12*d* at step M to initiate the detection of the humidity $H_M$ at step N. Then, at step O, the $T_{(\Delta H)}$ calculator 12*d* performs a calculation using the difference betweeen $H_M$ and Ho as $\Delta H$ to determine $T_{(\Delta H)}$ which is subsequently stored in the $T_{(\Delta H)}$ timer 13*c*. Subsequently, the total heating time $T_{total}$ $(=T_{(\Delta H)}+T_{(W)})$ is calculated by the $T_{(W)}$ and $T_{(\Delta H)}$ calculators 12*c* and 12*d* at step P, followed by the calculation of the remaining time through the display tube 7 at step R. The remaining time is counted down at step S, the total cooking time $T_{(W)}+T_{(\Delta H)}$ is measured by the $T_{(W)}$ and $T_{(\Delta H)}$ timers 13*b* and 13*c*, and, upon the passage of this time, the OFF signal generator 12*e* applies a signal to the heater deactivator 15*b* to interrupt the supply of the electric power to the heating unit 14**, thereby completing the cooking at step T.

It is to be noted that, although the detection timing $T_k$ may be any arbitratily chosen time, the illustrated embodiment has chosen 15 minutes therefor so that the difference $\Delta H$ relative to the minimum level of humidity subsequent to the start of cooking can bring about a difference from one kind of cake to another (for example, the difference between sponge cake and pound cake).

Also, since at the detection timing $T_k$ the total heating time is calculated, it is possible to calculate the remaining cooking time at that timing. If the remaining time is displayed by means of a display means and is counted down with the passage of time, the user of the apparatus can ascertain the remaining time and the apparatus will be convenient to handle. Moreover, if there is provided a warning means operable to issue a warning sound at the detection timing $T_k$ along with the display of the remaining time, the possibility of the user to fail to look at the display of the remaining time can be eliminated and, therefore, the apparatus will be easy to handle and attractive.

As an alternative form of embodiment of the present invention, instead of the use of the weight sensor, the present invention can be equally accomplished by designing a structure wherein the weight of the material to be heated can be inputted by the user. With this structure, the apparatus can be rendered to be inexpensive. In such case, although the manual intervention is required to input the weight, the automatic cooking can be accomplished in an optimum time regardless of the kind of cake and the shape of the vessel used.

The present invention having been fully described has the following effects.

(1) Even though the kind of cake changes, the optimum heating time can be automatically calculated, and different kinds of cake can be properly cooked with the single auto-key.

(2) Even if the amount of cake is changed according to the user's desire, the optimum heating time can be automatically calculated and, therefore, optimum cooking is possible.

(3) Even if the type of vessel is changed, the optimum cooking time can be automatically calculated and, therefore, no limitation is necessary as to the vessel.

(4) Since the remaining time is always displayed a predetermined time subsequent to the start of cooking, the apparatus can be easy for the user to handle.

Although the present invention has been fully described in connection with the preferred embodiment thereof with reference to the accompanying drawings, it is to be noted that the various changes and modifications are apparent to those skilled in the art. Such changes and modifications are, unless they depart from the scope of the present invention as defined by the appended claims, to be understood as included therein.

What is claimed is:

1. A heating apparatus comprising: a heating chamber for accommodating a material to be heated; a heating means for heating said material; a gas sensor for detecting the amount of change in humidity within said heating chamber; a weight sensor for detecting the weight of said material; a calculating means for performing a calculation using detected values of said gas and weight sensors; and an output control means which operates in response to a signal from said calculating means so as to interrupt the supply of electric power to said heating means to thereby terminate the heating of said material, said signal being generated by said calculating means wherein the sum of a first heating time and a second heating time has passed; wherein said calculating means includes a first heating time calculating means for calculating said first heating time on the basis of said detected value of said weight sensor, and a second heating time calculating means for calculating said second heating time according to the difference between a first detected value detected by said gas sensor at a time before the substantial heating of said material is effected and a second detected value detected by said gas sensor after a predetermined time subsequent to the substantial heating of said material.

2. An apparatus as claimed in claim 1, further comprising a display means for displaying a remaining time equal to the length of time from said predetermined time to the termination of heating.

3. An apparatus as claimed in claim 1, further comprising a display means for displaying a remaining time equal to the length of time from said predetermined time to the termination of heating, and a warning means for generating a voice sound calling the attention of a user, wherein said calculating means calculates a total cooking time a predetermined time after the start of cooking and displays said remaining time while causing the warning means to generate said voice sound.

4. A heating apparatus comprising: a heating chamber for accommodating a material to be heated; a heating means for heating said material; a gas sensor for detecting the amount of change in humidity within said heating chamber; a weight inputting means for inputting weight information of said material; a calculating means for performing a calculation using a detected value of said gas sensor and said weight information from said inputting means; and an output control means which operates in response to a signal from said calculating means so as to interrupt the supply of electric power to said heating means to thereby terminate the heating of said material, said signal being generated by said calculating means when the sum of a first heating time and a second heating time has passed; wherein said calculating means includes a first heating time calculating means for calculating said first heating time on the basis of said weight information, and a second heating time calculating means for calculating said second heating time according to the difference between a first detected value detected by said gas sensor at a time before the substantial heating of said material is effected and a second detected value detected by said gas sensor after a predetermined time subsequent to the substantial heating of said material.

5. An apparatus as claimed in claim 4, further comprising a display means for displaying a remaining time equal to the length of time from said predetermined time to the termination of heating.

6. An apparatus as claimed in claim 4, further comprising a display means for displaying a remaining time equal to the length of time from said predetermined time to the termination of heating, and a warning means for generating a voice sound calling the attention of a user, wherein said calculating means calculates a total cooking time a predetermined time after the start of cooking and displays said remaining time while causing the warning means to generate said voice sound.

7. A heating apparatus comprising: a heating chamber for accommodating a material to be heated; a heating means for heating said material; a gas sensor for detecting the amount of change in humidity within said heating chamber; a weight sensor for detecting the weight of said material; a calculating means for performing a calculation using detected values of said gas and weight sensors; and an output control means which operates in response to a signal from said calculating means so as to interrupt the supply of electric power to said heating means to thereby terminate the heating of said material, said signal being generated by said calculating means when the sum of a first heating time and a second heating time has passed; wherein said calculating means includes a first heating time calculating means for calculating said first heating time on the basis of said detected value of said weight sensor, and a second heating time calculating means for calculating said second heating time according to the difference between a minimum detected value of said gas sensor subsequent to the start of heating and said detected value of the gas sensor after a predetermined time subsequent to the start of heating.

8. An apparatus as claimed in claim 7, further comprising a display means for displaying a remaining time equal to the length of time from said predetermined time to the termination of heating.

9. An apparatus as claimed in claim 7, further comprising a display means for displaying a remaining time equal to the length of time from said predetermined time to the termination of heating, and a warning means for generating a voice sound calling the attention of a user, wherein said calculating means calculates a total cooking time a pedetermined time after the start of cooking and displays said remaining time while causing the warning means to generate said voice sound.

10. A method of heating a material using a heating apparatus having a heating chamber for accommodating the material and a heating means, which method comprises the steps of:

initiating the substantial heating of material upon calculating a first heating time with reference to the measured weight of the material in addition to measuring of a first humidity of the material, measuring a second humidity after the passage of a predetermined time subsequent to the initiation of the substantial heating and calculating a second heating time with reference to the difference between said first humidity and said second humidity; and terminating the heating when the length of time which has passed subsequent to the initiation of the heating becomes equal to the sum of the first and second heating times.

11. A method as claimed in claim 10, further comprising the step, subsequent to the step of calculating the second heating time, of calculating the sum of the first and second heating times and a step of progresssively displaying a remaining time required to pass until the termination of the heating and remaining time being equal to the sum of the first and second heating times minus the length of time which has passed subsequent to the initiation of the heating.

* * * * *